US011075482B2

(12) United States Patent
Matsuo et al.

(10) Patent No.: US 11,075,482 B2
(45) Date of Patent: Jul. 27, 2021

(54) WATER-RESISTANT ELECTRICAL CONNECTOR ASSEMBLY

(71) Applicant: JAPAN AVIATION ELECTRONICS INDUSTRY, LIMITED, Tokyo (JP)

(72) Inventors: Kosuke Matsuo, Tokyo (JP); Atsushi Tanaka, Tokyo (JP); Shinichiro Nakajima, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 201 days.

(21) Appl. No.: 16/332,945

(22) PCT Filed: Jun. 5, 2017

(86) PCT No.: PCT/JP2017/020745

§ 371 (c)(1),
(2) Date: Mar. 13, 2019

(87) PCT Pub. No.: WO2018/070073

PCT Pub. Date: Apr. 19, 2018

(65) Prior Publication Data

US 2019/0252825 A1 Aug. 15, 2019

(30) Foreign Application Priority Data

Oct. 13, 2016 (JP) ..... JP2016-201647

(51) Int. Cl.
*H01R 33/00* (2006.01)
*H01R 4/58* (2006.01)
(Continued)

(52) U.S. Cl.
CPC ..... *H01R 13/5219* (2013.01); *H01R 12/57* (2013.01); *H01R 12/771* (2013.01);
(Continued)

(58) Field of Classification Search
CPC .... H01R 13/5219; H01R 12/57; H01R 12/58; H01R 13/11
(Continued)

(56) References Cited

U.S. PATENT DOCUMENTS 5,197,892 A * 3/1993 Yoshizawa ..... H01L 23/295 174/535
6,027,367 A * 2/2000 Woertz ..... H01R 4/2483 439/497
(Continued)

FOREIGN PATENT DOCUMENTS

CN 204045832 U 12/2014
JP S51-2301 U 1/1976
(Continued)

OTHER PUBLICATIONS

Office Action issued in Chinese family member Patent Appl. No. 201780052718.7, dated May 15, 2020, along with an English translation thereof.
(Continued)

*Primary Examiner* — Abdullah A Riyami
*Assistant Examiner* — Thang H Nguyen
(74) *Attorney, Agent, or Firm* — Greenblum & Bernstein, P.L.C.

(57) ABSTRACT

A connector assembly of the present invention includes a first connector having a first electrical-connection member arranged on a base member, and a second connector having a second electrical-connection member arranged on a base member at a position opposite that of the first electrical-connection member. The first connector and the second connector further include engagement members at positions opposite each other. The first electrical-connection member includes an elastic protrusion and a first electrode arranged at a tip of the protrusion. The second electric-connection member includes a recess and a second electrode arranged at a bottom of the recess. At least one of the base member of the first connector and the base member of the second connector has flexibility. When the engagement members engage, the first electrode and the second electrode are
(Continued)

brought into contact, and the protrusion and the recess are brought into contact.

20 Claims, 10 Drawing Sheets

(51) Int. Cl.

| | |
|---|---|
| ***H01R 13/28*** | (2006.01) |
| ***H01R 25/00*** | (2006.01) |
| ***H01R 13/52*** | (2006.01) |
| ***H01R 12/77*** | (2011.01) |
| ***H01R 12/78*** | (2011.01) |
| ***H01R 13/24*** | (2006.01) |
| ***H01R 13/627*** | (2006.01) |
| ***H01R 13/639*** | (2006.01) |
| ***H01R 12/79*** | (2011.01) |
| ***H01R 12/57*** | (2011.01) |

(52) U.S. Cl.
CPC ..... *H01R 12/78* (2013.01); *H01R 12/79* (2013.01); *H01R 13/24* (2013.01); *H01R 13/52* (2013.01); *H01R 13/6271* (2013.01); *H01R 13/639* (2013.01)

(58) Field of Classification Search
USPC ..... 439/37, 86, 90, 91, 285
See application file for complete search history.

(56) References Cited

U.S. PATENT DOCUMENTS

| | | | | |
|---|---|---|---|---|
| 6,805,563 | B2 * | 10/2004 | Ohashi | H05K 7/1061 439/331 |
| 7,014,479 | B2 * | 3/2006 | Li | H01L 23/49811 257/E23.067 |
| 7,435,101 | B2 * | 10/2008 | Yoneta | H01R 13/2414 439/67 |
| 10,835,018 | B2 * | 11/2020 | Beck | A45F 3/08 |
| 10,835,706 | B2 * | 11/2020 | Lajarin Barquero | A61N 1/0502 |
| 10,940,080 | B2 * | 3/2021 | Zipper | A61H 23/00 |
| 2014/0087572 | A1 * | 3/2014 | Saur | H01R 12/714 439/81 |
| 2015/0064984 | A1 * | 3/2015 | Chiba | H01R 12/714 439/700 |
| 2015/0357078 | A1 * | 12/2015 | Lessing | H01B 1/24 73/774 |
| 2016/0181729 | A1 * | 6/2016 | Barth | A41D 1/005 439/37 |
| 2018/0062310 | A1 | 3/2018 | Matsuo et al. | |
| 2020/0036115 | A1 * | 1/2020 | Matsuo | H05K 3/365 |
| 2020/0295489 | A1 * | 9/2020 | Chen | H01R 13/6582 |
| 2020/0330125 | A1 * | 10/2020 | Millis | A61B 90/06 |

FOREIGN PATENT DOCUMENTS

| | | | | |
|---|---|---|---|---|
| JP | H7-29758 U | | 6/1995 | |
| JP | 2004-241187 A | | 8/2004 | |
| JP | 2004241187 | * | 8/2004 | H01R 13/11 |
| JP | 2005-225516 A | | 8/2005 | |
| JP | 2006-055280 A | | 3/2006 | |
| JP | 2008-091091 A | | 4/2008 | |
| JP | 2015-135723 A | | 7/2015 | |
| JP | 2016-097273 A | | 5/2016 | |

OTHER PUBLICATIONS

U.S. Appl. No. 16/337,034 to Kosuke Matsuo et al., which was filed on Mar. 27, 2019.

Office Action issued in Chinese family member Patent Appl. No. 201780052718.7, dated Nov. 4, 2019, along with an English translation thereof.

* cited by examiner

PRIOR ART

WATER-RESISTANT ELECTRICAL CONNECTOR ASSEMBLY

TECHNICAL FIELD

The present invention relates to a connector assembly used to take out an electrical signal from a device that is attached to clothing or a human body.

BACKGROUND ART

As a connector used to take out an electrical signal from a device that is attached to clothing or a human body, technology such as that described in Patent Literature 1 has been known. FIG. 1 shows FIG. 2 illustrated in Patent Literature 1. The abstract of Patent Literature 1 describes, as a problem, "providing a connector that can prevent the sense of wearing and durability from being impaired", and as solving means, "a snap-button connector includes a first cloth 1 having electrical conductivity, a second cloth 2 having electrical conductivity, a snap button 3 that detachably connects the other end of the first cloth 1 and the other end of the second cloth 2 mechanically and electrically. This snap button 3 includes a male snap button 4 connected to the first cloth 1 mechanically and electrically and made of a material having electrical conductivity, and a female snap button 5 connected to the second cloth 2 mechanically and electrically and made of a material having electrical conductivity". Conventional technology for resin fasteners includes that described in Patent Literature 2 and 3.

PRIOR ART LITERATURE

Patent Literature

Patent Literature 1: Japanese Patent Application Laid Open No. 2015-135723

Patent Literature 2: Japanese Patent Application Laid Open No. 2005-225516

Patent Literature 3: Japanese Patent Application Laid Open No. 2006-55280

SUMMARY OF THE INVENTION

Problems to be Solved by the Invention

The technology described in Patent Literature 1 provides a wearable-device connector attached to clothing or a human body, but its electrical-connection members do not have drip-proof structures (structures that prevent water drops from adhering thereto). Therefore, the connector has a problem in that the electrical-connection members tend to deteriorate due to water drops adhering thereto in living environments.

An object of the present invention is to provide a connector assembly having waterproofness at least in living environments.

Means to Solve the Problems

A connector assembly of the present invention includes a first connector having a first electrical-connection member arranged on a base member, and a second connector having a second electrical-connection member arranged on a base member at a position opposite that of the first electrical-connection member. The first connector and the second connector further include engagement members at positions opposite each other. The first electrical-connection member includes an elastic protrusion and a first electrode arranged at a tip of the protrusion. The second electric-connection member includes a recess and a second electrode arranged at a bottom of the recess. At least one of the base member of the first connector and the base member of the second connector is flexible. When the engagement members engage, the first electrode and the second electrode are brought into contact, and the protrusion and the recess are brought into contact so as to prevent water from reaching the contact point of the first electrode and the second electrode.

Effects of the Invention

According to a connector assembly of the present invention, since the first electrical-connection member and the second electrical-connection member easily provide positioning and water-tightness, waterproofness is provided at least in living environments.

DETAILED DESCRIPTION OF THE EMBODIMENTS

Embodiments of the present invention will be described below in detail. Identical numbers are assigned to components having identical functions, and a duplicate description thereof will be omitted.

First Embodiment

Figure 1:
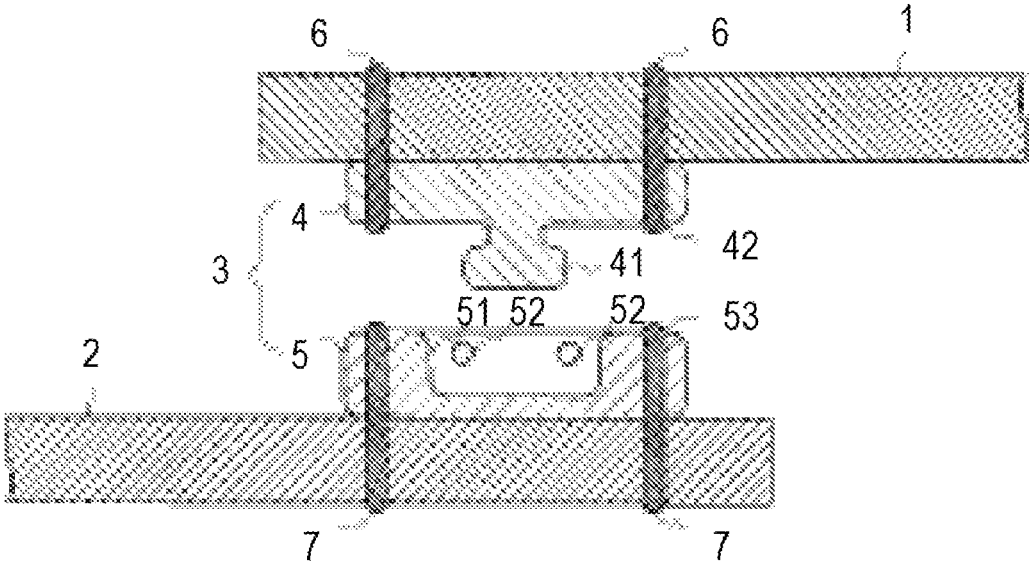
FIG. 1 shows FIG. 2 illustrated in Patent Literature 1.
Figure 2:
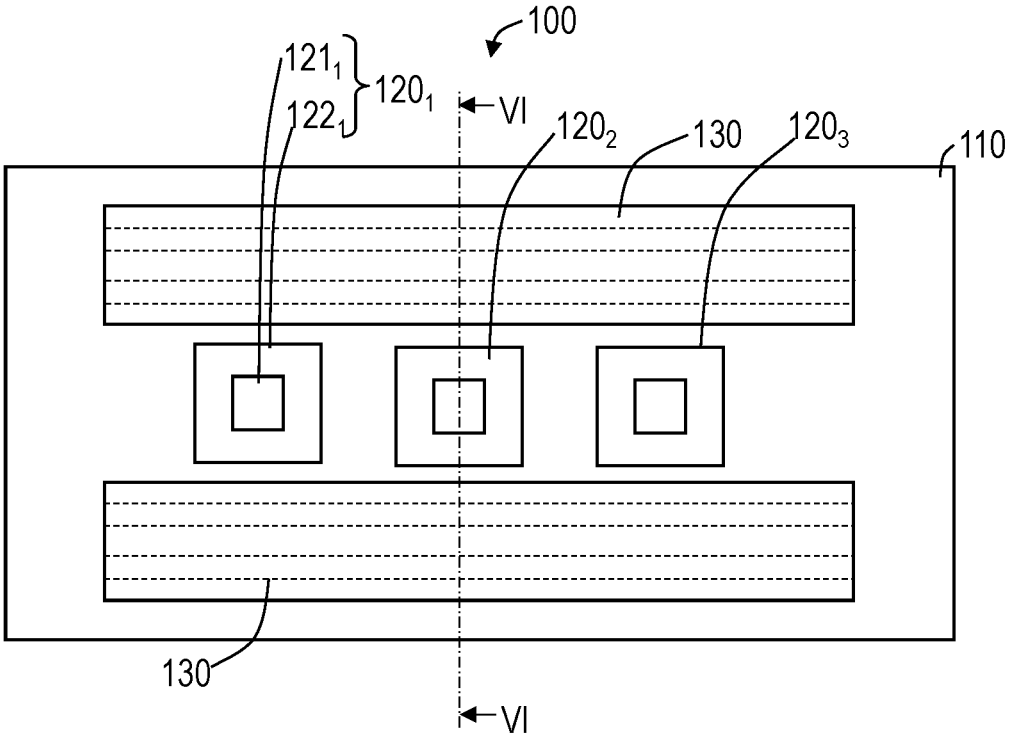
FIG. 2 is a plan of a first connector used in a first embodiment.
Figure 3:
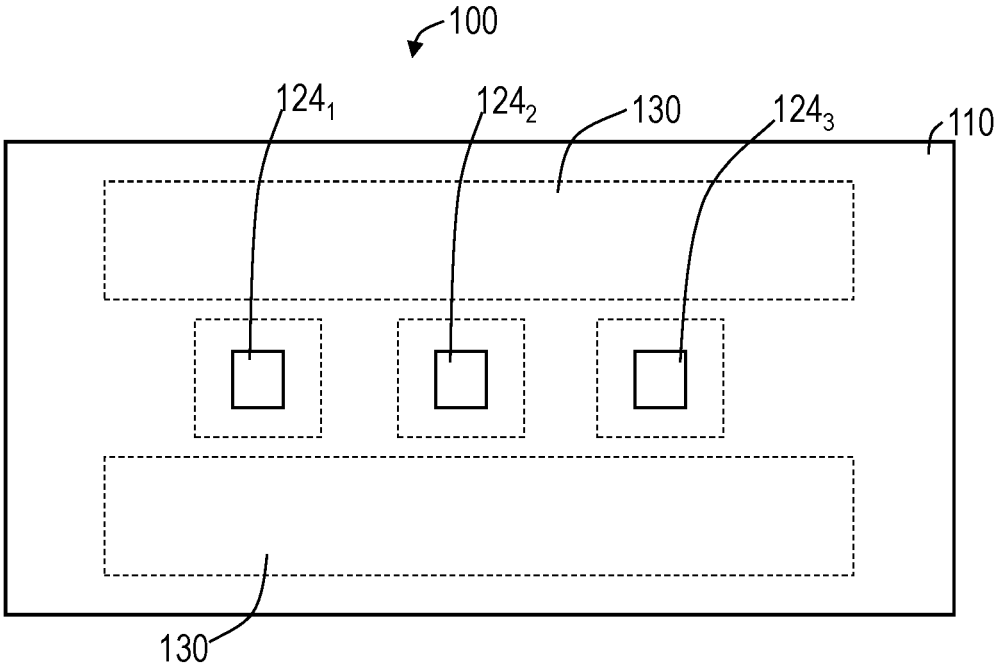
FIG. 3 is a rear view of the first connector used in the first embodiment.
Figure 4:
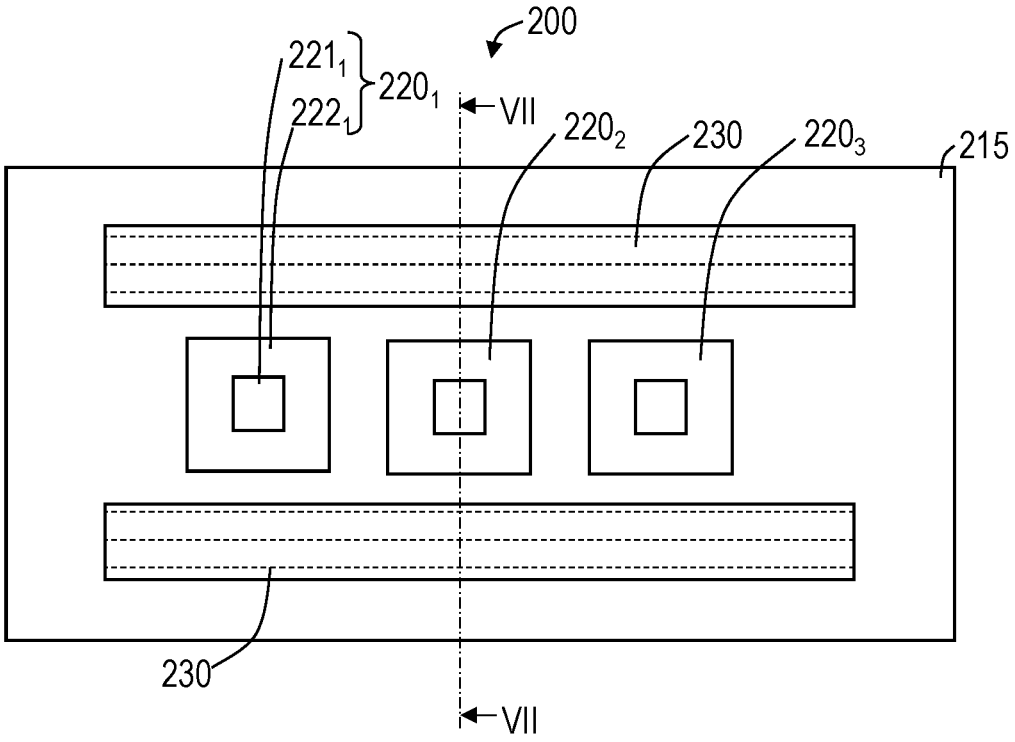
FIG. 4 is a plan of a second connector used in the first embodiment.
Figure 5:
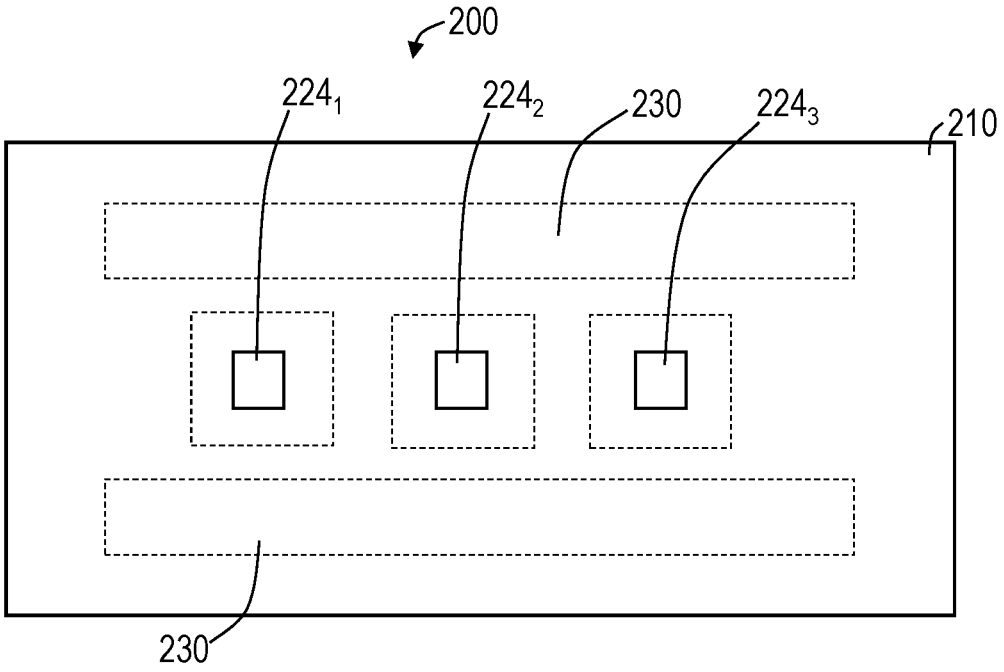
FIG. 5 is a rear view of the second connector used in the first embodiment.
Figure 6:
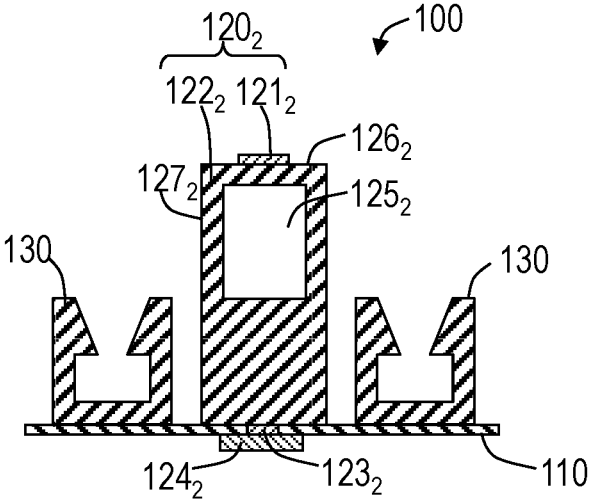
FIG. 6 is a cross-sectional view along VI-VI in FIG. 2.
Figure 7:
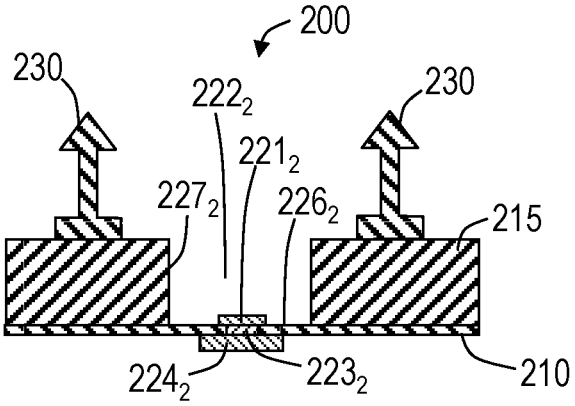
FIG. 7 is a cross-sectional view along VII-VII in FIG. 4.
Figure 8:
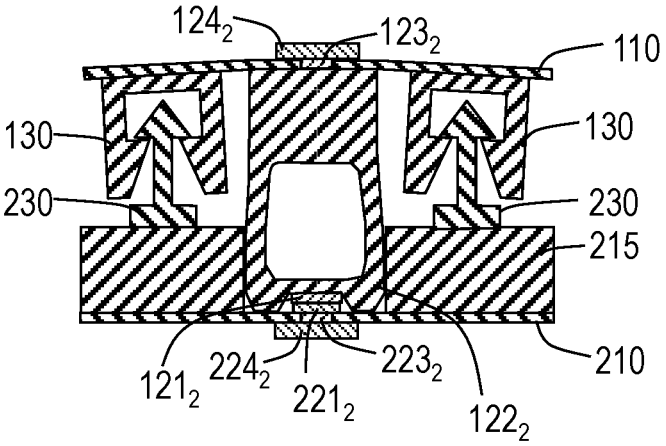
FIG. 8 is a cross-sectional view at the position indicated by VI-VI in FIG. 2 and VII-VII in FIG. 4 when the first connector and the second connector used in the first embodiment are joined.

FIG. 2 is a plan of a first connector used in a first embodiment. FIG. 3 is a rear view of the first connector. FIG. 4 is a plan of a second connector used in the first embodiment. FIG. 5 is a rear view of the second connector. FIG. 6 is a cross-sectional view along VI-VI in FIG. 2. FIG. 7 is a cross-sectional view along VII-VII in FIG. 4. FIG. 8 is a cross-sectional view at the position indicated by VI-VI in FIG. 2 and VII-VII in FIG. 4 when the first connector and the second connector used in the first embodiment are joined. The first connector shown in FIG. 6 is illustrated up-side down in FIG. 8.

A connector assembly according to the first embodiment includes a first connector 100 and a second connector 200. The first connector 100 includes first electrical-connection members $\mathbf{120}_1$ to $\mathbf{120}_N$ (N is an integer equal to or larger than 1; N=3 in FIGS. 2 and 3) arranged on a base member 110. The second connector 200 includes second electrical-connection members $\mathbf{220}_1$ to $\mathbf{220}_N$ (N=3 in FIGS. 4 and 5) on a base member 210 at the positions opposite those of the first electrical-connection members $\mathbf{120}_1$ to $\mathbf{120}_N$. N equals 3 in FIGS. 2 to 5, but it is not limited to that value and should be set to a required value. In FIGS. 6 to 8, the first electrical-connection members $\mathbf{120}_1$ to $\mathbf{120}_N$ are directly arranged on the base member 110, and the second electrical-connection members $\mathbf{220}_1$ to $\mathbf{220}_N$ are directly arranged on the base member 210. Here, "being arranged on the base member" means not only being directly arranged on the base member but also being indirectly arranged on the base member with another member placed between the base member and the electrical-connection members (this also applies to second and third embodiments).

At least one of the base member 110 of the first connector 100 and the base member 210 of the second connector 200 has flexibility. Both the base member 110 and the base member 210 can have flexibility. Materials used for a flexible base member include a film such as films of polyimide, polyester, polypyrene, polystyrene, polyethylene, and vinyl chloride. Materials used for a non-flexible base member include thermosetting plastic, such as phenolic resin, epoxy, melanin, and polyurethane, general-purpose plastic, such as polyethylene, Teflon (registered trademark), ABS resin, and acrylic resin, and engineering plastic, such as nylon polycarbonate and liquid crystal polymer.

The first connector 100 and the second connector 200 further include engagement members 130 and engagement members 230, respectively, at positions opposite to each other. The engagement members 130 and 230 are shown in FIGS. 2 to 8. The engagement members 130 have recesses, as shown in FIG. 6, the engagement members 230 have protrusions, as shown in FIG. 7, and the engagement members engage, as shown in FIG. 8. In this embodiment, the engagement members 130 are arranged on the base member 110, and the engagement members 230 are arranged on a recess forming part 215. The protrusions and the recesses of the engagement members may be made reversely (the engagement members 230 may be disposed in the first connector 100 and the engagement members 130 may be disposed in the second connector 200). When a resin fastener having such a shape is used for the engagement members, for example, they can be easily attached and detached. A thermoplastic resin should be used, such as low-density polyethylene, ethylene-α-olefin copolymer, ethylene-vinyl-acetate copolymer, ethylene-acrylic-acid copolymer, and ethylene-acrylic-acid-ester copolymer. When the engagement members are made of resin, the engagement members should be secured to the base member 110 or the recess forming part 215 by adhesive or thermal fusion. Patent Literature 2 and 3, and other documents describe resin fasteners in detail. In the connector assembly of the present application, since it is not requisite that the engagement members be water-tight, the engagement members may have another shape, such as that of buttons.

The first electrical-connection members $\mathbf{120}_n$ and the second electrical-connection members $\mathbf{220}_n$ (n is an integer equal to or larger than 1 and equal to or smaller than N; n=2 in FIGS. 6 to 8) will be described by referring to FIGS. 6 to 8. The first electrical-connection member $\mathbf{120}_n$ includes an elastic protrusion $\mathbf{122}_n$ and a first electrode $\mathbf{121}_n$ disposed at a tip $\mathbf{126}_n$ of the protrusion $\mathbf{122}_n$. In an example shown in FIG. 6, a space $\mathbf{125}_n$ is formed to make the protrusion $\mathbf{122}_n$ hollow. Since the protrusion $\mathbf{122}_n$ is made hollow, it is deformed more easily. The second electrical-connection member $\mathbf{220}_n$ includes a recess $\mathbf{222}_n$ and a second electrode $\mathbf{221}_n$ disposed at a bottom $\mathbf{226}_n$ of the recess $\mathbf{222}_g$. The recess $\mathbf{222}_n$ is formed by providing the recess forming part 215 on the base member 210. When the engagement members 130 and 230 engage as shown in FIG. 8, the first electrode $\mathbf{121}_n$ and the second electrode $\mathbf{221}_n$ are brought into contact. Since at least the protrusion $\mathbf{122}_n$ is deformed, at least part of the side face $\mathbf{127}_n$ of the protrusion $\mathbf{122}_n$ touches the side face $\mathbf{227}_n$ of the recess $\mathbf{222}_n$ over the perimeter. Therefore, water-tightness is provided, and water from the outside is prevented from reaching the contact point of the first electrode $\mathbf{121}_n$ and the second electrode $\mathbf{221}_n$. In addition, in the example shown in FIG. 8, the tip $\mathbf{126}_n$ of the protrusion $\mathbf{122}_n$, except for the portion where the first electrode $\mathbf{121}_n$ is formed, touches the bottom $\mathbf{226}_n$ of the recess $\mathbf{222}_n$, except for the portion where the second electrode $\mathbf{221}_n$ is formed, so as to surround the first electrode $\mathbf{121}_n$ and the second electrode $\mathbf{221}_n$. Water-tightness is also provided with this contact that surrounds the first electrode $\mathbf{121}_n$ and the second electrode $\mathbf{221}_n$, and water from the outside is prevented from reaching the contact point of the first electrode $\mathbf{121}_n$ and the second electrode $\mathbf{122}_n$. In the example shown in FIG. 8, water-tightness is provided at the two locations, but either of them may be used. As described above, since the connector assembly of the first embodiment provides water-tightness by bringing the protrusions $\mathbf{122}_n$ and the recesses $\mathbf{222}_n$ into contact, the connector assembly has waterproofness at least in living environments.

When the protrusion $\mathbf{122}_n$ is soft, and when the engagement members 130 and 230 engage, if the protrusion $\mathbf{122}_n$ and the recess $\mathbf{222}_n$ are brought into contact to provide water-tightness, the recess $\mathbf{222}_n$ may be non-elastic. If the elasticity of the protrusion $\mathbf{122}_n$ itself alone does not provide water-tightness, however, the recess $\mathbf{222}_n$ should be elastic. The recess $\mathbf{222}_n$ being elastic means the recess forming part 215 being elastic. When the recess $222_n$ is elastic, rubber materials can be used for the recess forming part 215 and the protrusions $122_n$, such as elastomer, polyurethane, polyester, polyamide, polystyrene, polyolefin, vinyl chloride, styrene-butadiene rubber, chloroprene rubber, ethylene propylene rubber silicone, and fluororubber. When the recess $222_n$ is non-elastic, any of the materials used for the non-flexible base member, described above, should be used for the recess forming part 215, and the base member 210 and the recess forming part 215 may be formed as a unit. In FIGS. 2 to 8, both the protrusions $122_n$ and the recesses $222_n$ are rectangular and the corners are explicitly illustrated. Both the protrusions $122_n$ and the recesses $222_n$, however, may be rounded at the corners. In the protrusions $122_n$, the tips $126_n$ may be rounded on the whole.

Figure 9:
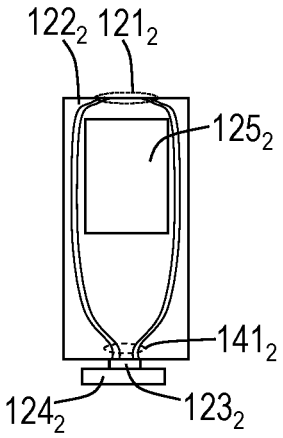
FIG. 9 is a view showing a first example of a method in which a first electrode $\mathbf{121}_n$ and a conductor $\mathbf{123}_n$ are electrically connected.
Figure 10:
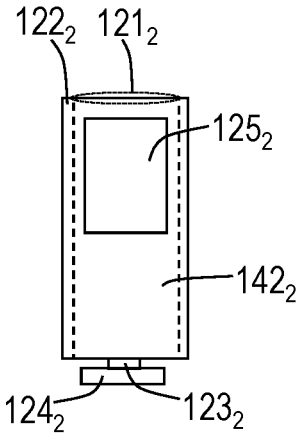
FIG. 10 is a view showing a second example of the method in which the first electrode $\mathbf{121}_n$ and the conductor $\mathbf{123}_n$ are electrically connected.
Figure 11:
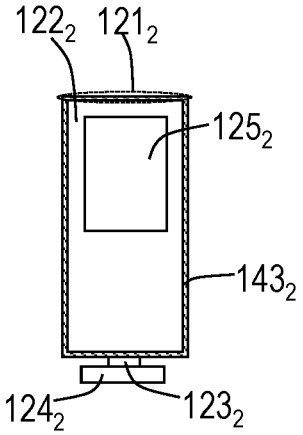
FIG. 11 is a view showing a third example of the method in which the first electrode $\mathbf{121}_n$ and the conductor $\mathbf{123}_n$ are electrically connected.

Although not shown in FIGS. 6 and 8, the first electrode $121_n$ is electrically connected to a terminal $124_n$ via a conductor $123_n$ formed in a through-hole of the base member 110 by some method. FIGS. 9 to 11 show examples of a method for electrically connecting the first electrode $121_n$ and the conductor $123_n$. In the example shown in FIG. 9, the first electrode $121_n$ and the conductor $123_n$ are connected by a plurality of conductive thin wires $141_n$ disposed inside the protrusion $122_n$. The conductive thin wires $141_n$ are deformable as the protrusion $122_n$ is deformed. In the example shown in FIG. 9, a portion (portion surrounded by a dotted line) of the conductive thin wires $141_n$ exposed from the tip $126_n$ of the protrusion $122_n$ serves as the first electrode $121_n$. Therefore, the first electrode $121_n$ shown in FIGS. 6 and 8 is not shown in FIG. 9. In the example shown in FIG. 10, the first electrode $121_n$ and the conductor $123_n$ are connected by an electrically conductive rubber $142_n$. In the example shown in FIG. 10, a portion (portion surrounded by a dotted line) where the electrically conductive rubber $142_n$ is exposed from the tip $126_n$ of the protrusion $122_n$ serves as the first electrode $121_n$. Therefore, the first electrode $121_n$ shown in FIGS. 6 and 8 is not shown in FIG. 10, either. In the example shown in FIG. 11, the first electrode $121_n$ and the conductor $123_n$ are connected by an electrically conductive thin film $143_n$ formed in the area surrounding the protrusion $122_n$. In the example shown in FIG. 11, the electrically conductive thin film $143_n$ formed at the tip $126_n$ of the protrusion $122_n$ serves as the first electrode $121_n$. The method for electrically connecting the first electrode $121_n$ and the conductor $123_n$ is not necessarily limited to the above-described three methods. As shown in FIGS. 7 and 8, the second electrode $221_n$ is electrically connected to a terminal $224_n$ via a conductor $223_n$ formed in a through-hole of the base member 210. Either one of the terminal $124_n$ and the terminal $224_n$ is connected to a device attached to clothing or a human body, and the other is connected to an outside measuring instrument or another apparatus.

According to the connector assembly of the first embodiment, since the first electrical-connection members and the second electrical-connection members easily provide positioning and water-tightness, waterproofness is provided at least in living environments. In the above embodiment, the engagement members are a resin fastener as an example. Since the engagement members are not required to be waterproof, an appropriate one(s) should be selected on the basis of the use.

Second Embodiment

Figure 12:
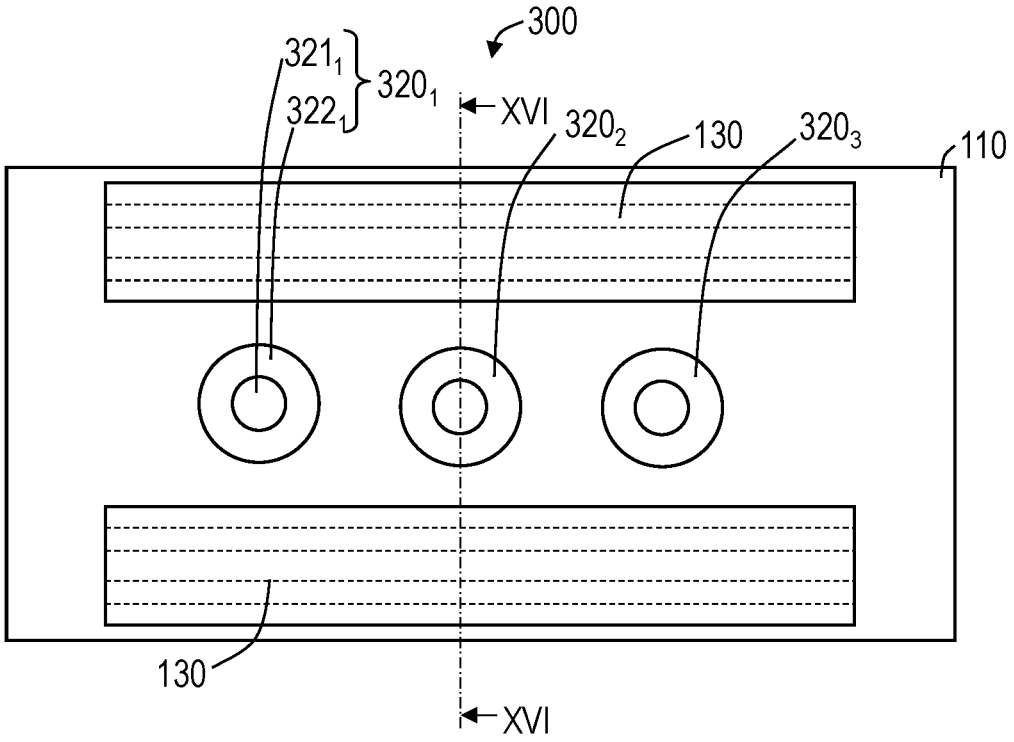
FIG. 12 is a plan of a first connector used in a second embodiment.
Figure 13:
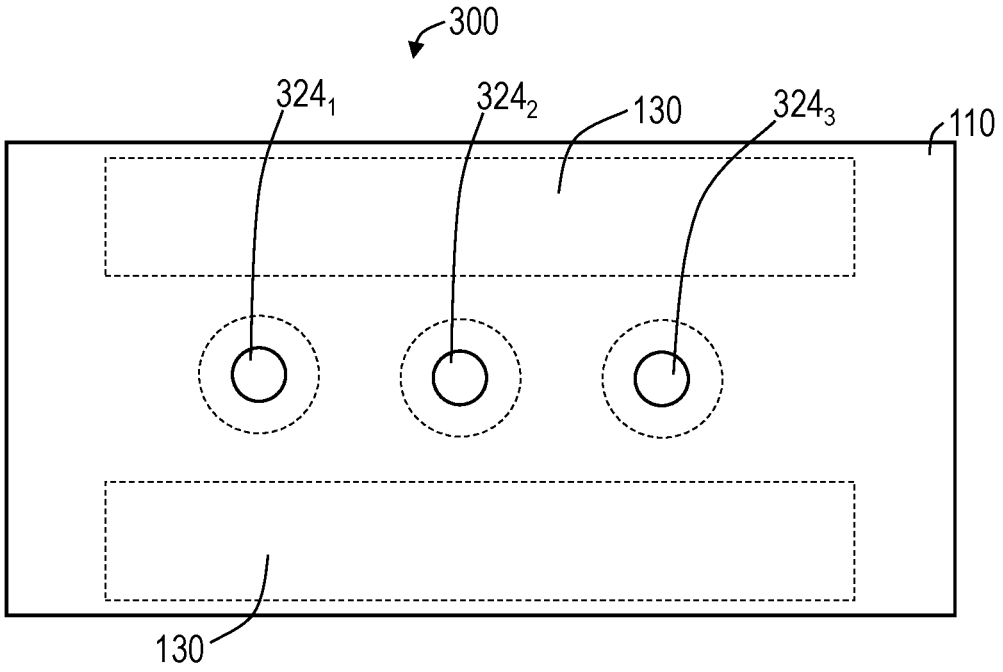
FIG. 13 is a rear view of the first connector used in the second embodiment.
Figure 14:
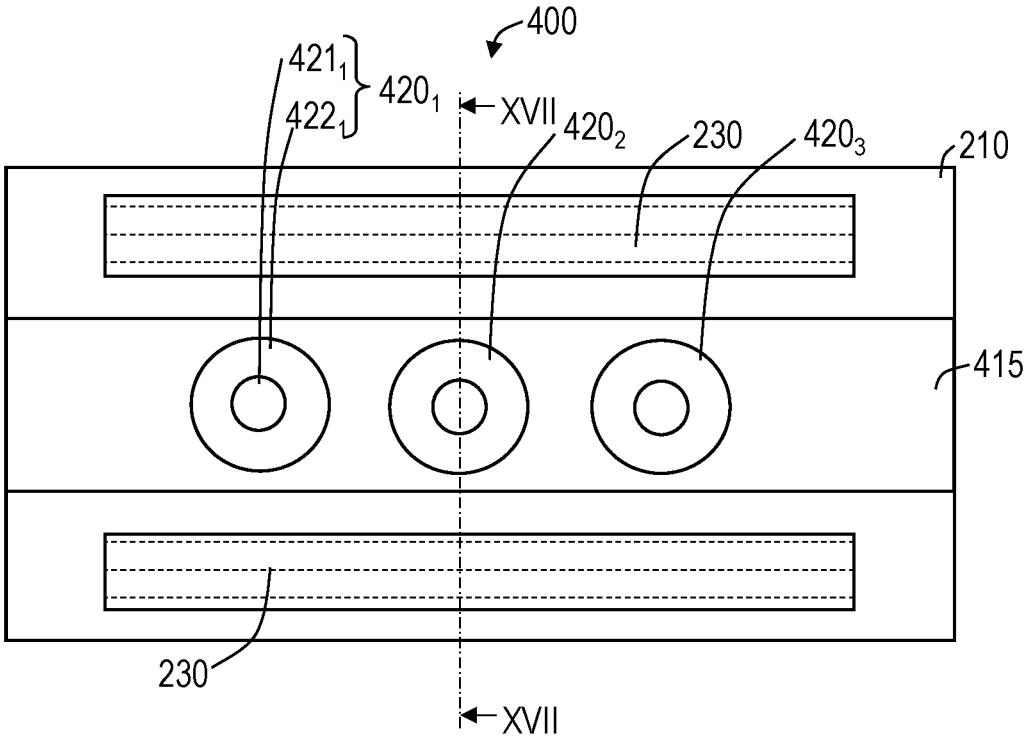
FIG. 14 is a plan of a second connector used in the second embodiment and a third embodiment.
Figure 15:
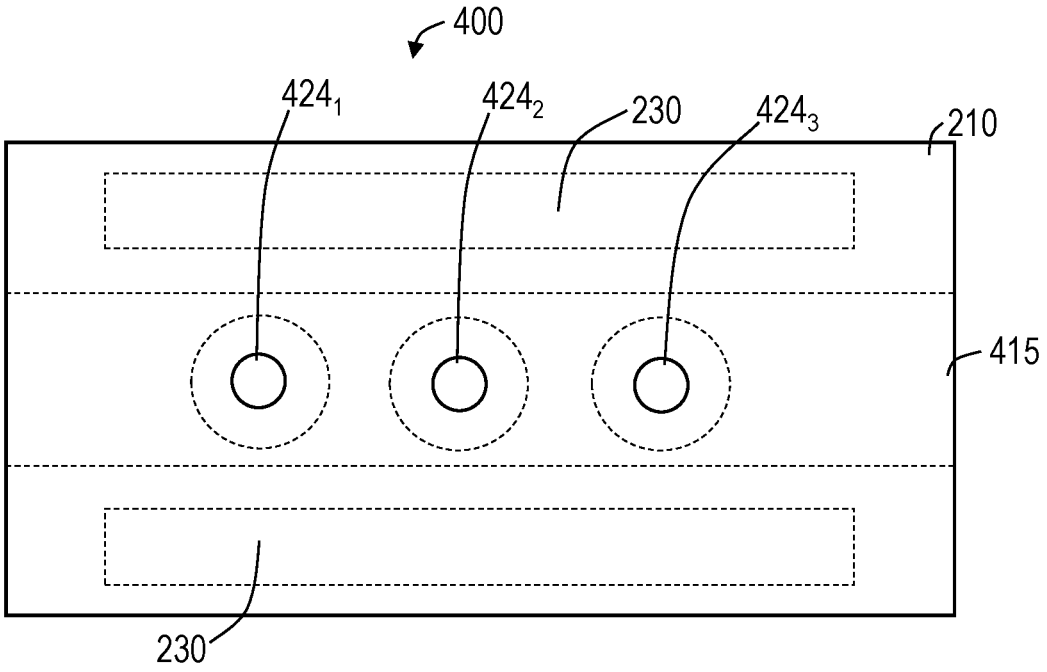
FIG. 15 is a rear view of the second connector used in the second and third embodiments.
Figure 16:
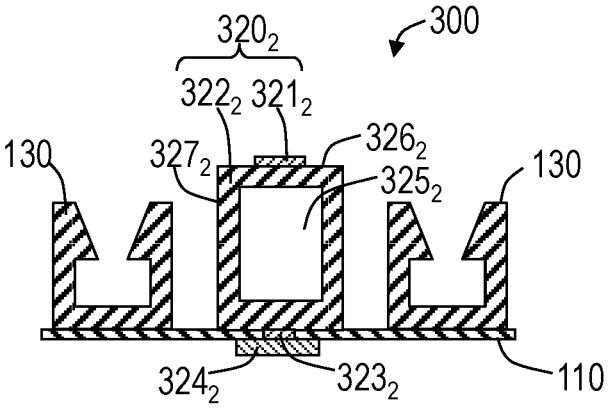
FIG. 16 is a cross-sectional view along XVI-XVI in FIG. 12.
Figure 17:
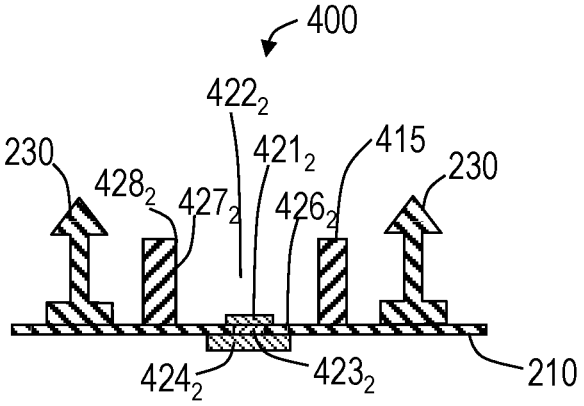
FIG. 17 is a cross-sectional view along XVII-XVII in FIG. 14.
Figure 18:
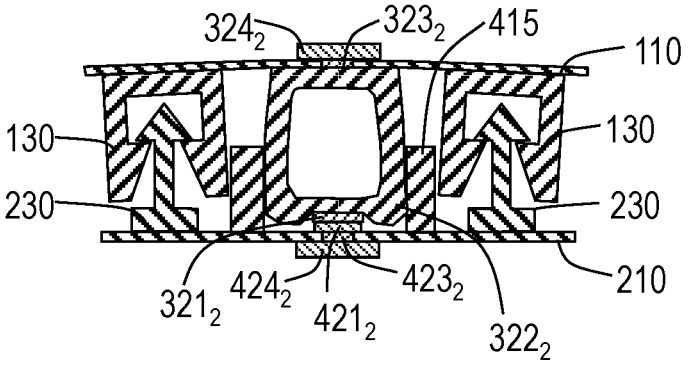
FIG. 18 is a cross-sectional view at the position indicated by XVI-XVI in FIG. 12 and XVII-XVII in FIG. 14 when the first connector and the second connector used in the second embodiment are joined.

FIG. 12 is a plan of a first connector used in a second embodiment. FIG. 13 is a rear view of the first connector. FIG. 14 is a plan of a second connector used in the second embodiment. FIG. 15 is a rear view of the second connector. FIG. 16 is a cross-sectional view along XVI-XVI in FIG. 12. FIG. 17 is a cross-sectional view along XVII-XVII in FIG. 14. FIG. 18 is a cross-sectional view at the position indicated by XVI-XVI in FIG. 12 and XVII-XVII in FIG. 14 when the first connector and the second connector used in the second embodiment are joined. The first connector shown in FIG. 16 is illustrated up-side down in FIG. 18.

A connector assembly according to the second embodiment includes a first connector 300 and a second connector 400. The first connector 300 includes first electrical-connection members $320_1$ to $320_N$ (N is an integer equal to or larger than 1; N=3 in FIGS. 12 and 13) arranged on a base member 110. The second connector 400 includes second electrical-connection members $420_1$ to $420_N$ (N=3 in FIGS. 14 and 15) on a base member 210 at the positions opposite those of the first electrical-connection members $320_1$ to $320_N$. N equals 3 in FIGS. 12 to 15, but it is not limited to that value and should be set to a required value. The second embodiment differs from the first embodiment in that the first electrical-connection members $320_1$ to $320_N$ and second electrical-connection members $420_1$ to $420_N$ are cylindrical, and engagement members 230 are disposed on the base member 210. Because of the latter difference, a recess forming part 415 is narrow and protrusions $322_1$ to $322_N$ are low. Therefore, the connector assembly of the second embodiment is thinner than the connector assembly of the first embodiment in the engaged state.

The base member 110 and the base member 210 are the same as those in the first embodiment. Engagement members 130 and 230 of the second embodiment differ from those of the first embodiment only in that the engagement members 230 are directly disposed on the base member 210. Also in the second embodiment, since it is not requisite that the engagement members be water-tight, the engagement members may have another shape, such as that of buttons.

The first electrical-connection members $320_n$ and the second electrical-connection members $420_n$ (n is an integer equal to or larger than 1 and equal to or smaller than N; n=2 in FIGS. 16 to 18) will be described by referring to FIGS. 16 to 18. The first electrical-connection member $320_n$ includes an elastic protrusion $322_n$ and a first electrode $321_n$ disposed at a tip $326_n$ of the protrusion $322_n$. In an example shown in FIG. 16, a space $325_n$ is formed to make the protrusion $322_n$ hollow. Since the protrusion $322_n$ is made hollow, it is deformed more easily. The second electrical-connection member $420_n$ includes a recess $422_n$ and a second electrode $421_n$ disposed at a bottom $426_n$ of the recess $422_n$. The recess $422_n$ is formed by providing the recess forming part 415 on the base member 210. When the engagement members 130 and 230 engage as shown in FIG. 18, the first electrode $321_n$ and the second electrode $421_n$ are brought into contact. Since at least the protrusion $322_n$ is deformed, at least part of the side face $327_n$ of the protrusion $322_n$ touches the side face $427_n$ of the recess $422_n$ over the perimeter thereof. Therefore, water-tightness is provided, and water from the outside is prevented from reaching the contact point of the first electrode $321_n$ and the second electrode $421_n$. As described above, since the connector assembly of the second embodiment provides water-tightness by bringing the protrusions $322_n$ and the recesses $422_n$ into contact, the connector assembly has waterproofness at least in living environments. As in the first embodiment, the tip $326_n$ of the protrusion $322_n$, except for the portion where the first electrode $321_n$ is formed, may touch the bottom $426_n$ of the recess $422_n$, except for the portion where the second electrode $421_n$ is formed, so as to surround the first electrode $321_n$ and the second electrode $421_n$. The recess $422_n$ may be elastic. In the protrusion $322_n$, the tip $326_n$ may be rounded on the whole.

The first electrode $321_n$ is electrically connected to a terminal $324_n$ via a conductor $323_n$ formed in a through-hole of the base member 110 by some method. Specific examples of the connection method are the same as those in the first embodiment (FIGS. 9 to 11). As shown in FIGS. 17 and 18, the second electrode $421_n$ is electrically connected to a terminal $424_n$ via a conductor $423_n$ formed in a through-hole of the base member 210. Either one of the terminal $324_n$ and the terminal $424_n$ is connected to a device attached to clothing or a human body, and the other is connected to an outside measuring instrument or another apparatus. Since the connector assembly of the second embodiment has the above-described structure, it provides the same effect as the first embodiment.

Third Embodiment

Figure 19:
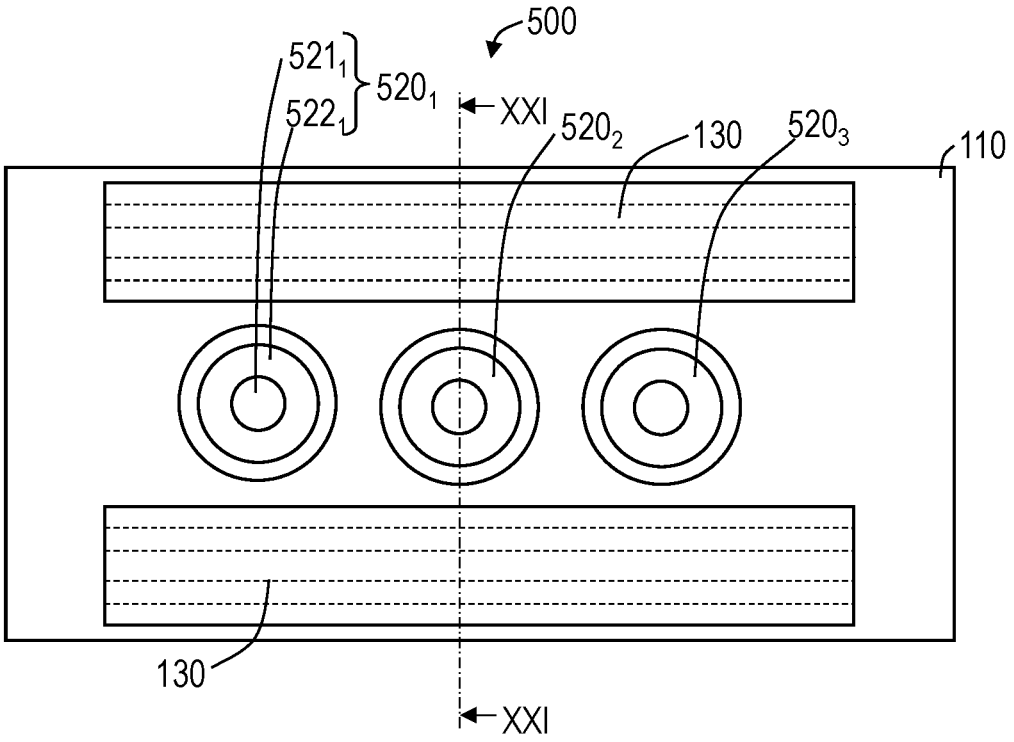
FIG. 19 is a plan of a first connector used in the third embodiment.
Figure 20:
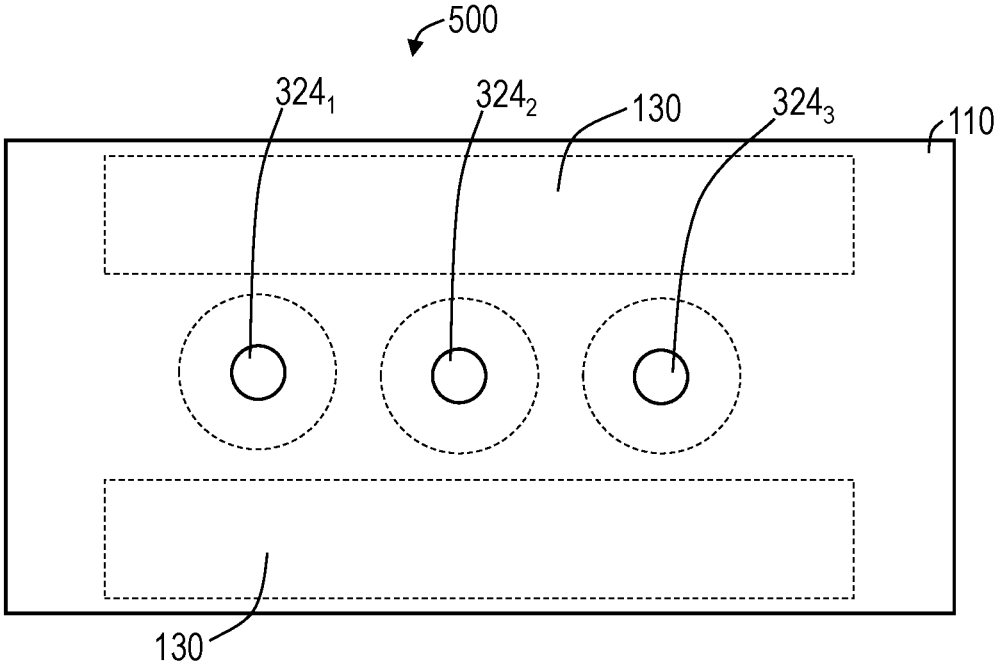
FIG. 20 is a rear view of the first connector used in the third embodiment.
Figure 21:
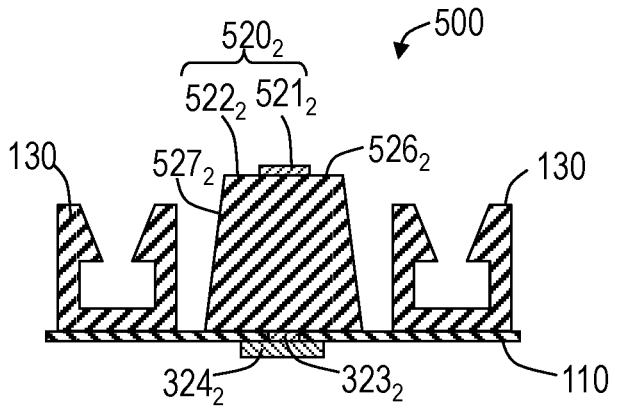
FIG. 21 is a cross-sectional view along XXI-XXI in FIG. 19.
Figure 22:
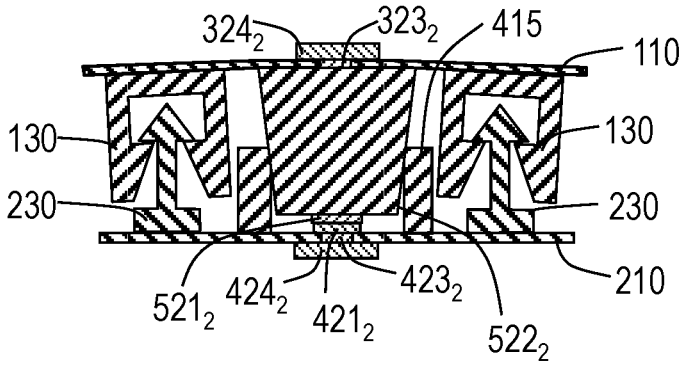
FIG. 22 is a cross-sectional view at the position indicated by XXI-XXI in FIG. 19 and XVII-XVII in FIG. 14 when the first connector and the second connector used in the third embodiment are joined.

FIG. 19 is a plan of a first connector used in a third embodiment. FIG. 20 is a rear view of the first connector. FIG. 14 is a plan of a second connector used in the third embodiment. FIG. 15 is a rear view of the second connector. FIG. 21 is a cross-sectional view along XXI-XXI in FIG. 19. FIG. 22 is a cross-sectional view at the position indicated by XXI-XXI in FIG. 19 and XVII-XVII in FIG. 14 when the first connector and the second connector used in the third embodiment are joined. The first connector shown in FIG. 21 is illustrated up-side down in FIG. 22.

A connector assembly according to the third embodiment includes a first connector 500 and a second connector 400. The first connector 500 includes first electrical-connection members $520_1$ to $520_N$ (N is an integer equal to or larger than 1; N=3 in FIGS. 19 and 20) arranged on a base member 110. The second connector 400 is the same as that in the second embodiment. N equals 3 in FIGS. 14, 15, 19, and 20, but it is not limited to that value and should be set to a required value. The third embodiment differs from the second embodiment in that protrusions $522_n$ are made narrower toward tips $526_n$ thereof.

The base member 110 and a base member 210 are the same as those in the first embodiment. Engagement members 130 and 230 of the third embodiment differ from those of the first embodiment only in that the engagement members 230 are directly disposed on the base member 210. Also in the third embodiment, since it is not requisite that the engagement members be water-tight, the engagement members may have another shape, such as that of buttons.

The first electrical-connection members $520_n$ and the second electrical-connection members $420_n$ (n is an integer equal to or larger than 1 and equal to or smaller than N; n=2 in FIGS. 17, 21, and 22) will be described by referring to FIGS. 17, 21, and 22. The first electrical-connection member $520_n$ includes an elastic protrusion $522_n$ having a shape narrowed toward the tip and a first electrode $521_n$ disposed at the tip $526_n$ of the protrusion $522_n$. In an example shown in FIG. 21, the protrusion $522_n$ is not made hollow, but a space may be made in the protrusion $522_n$, as in the first and second embodiments. The second electrical-connection member $420_n$ is the same as that of the second embodiment. When the engagement members 130 and 230 engage as shown in FIG. 22, the first electrode $521_n$ and the second electrode $421_n$ are brought into contact. The side face $527_n$ of the protrusion $522_n$ touches an opening $428_n$ of a recess $422_n$ over the perimeter thereof. Since at least the protrusion $522_n$ is elastic, it is easier to bring the first electrode $521_n$ and the second electrode $421_n$ into contact and to bring the side face $527_n$ of the protrusion $522_n$ and the opening $428_n$ of the recess $422_n$ into contact over the perimeter thereof. Therefore, water-tightness is provided, and water from the outside is prevented from reaching the contact point of the first electrode $521_n$ and the second electrode $421_n$. As described above, since the connector assembly of the third embodiment provides water-tightness by bringing the protrusions $522_n$ and the recesses $422_n$ into contact, the connector assembly has waterproofness at least in living environments. As in the first embodiment, the tip $526_n$ of the protrusion $522_n$, except for the portion where the first electrode $521_n$ is formed, may touch the bottom $426_n$ of the recess $422_n$, except for the portion where the second electrode $421_n$ is formed, so as to surround the first electrode $521_n$ and the second electrode $421_n$. The recess $422_n$ may be elastic. In the protrusion $522_n$, the tip $526_n$ may be rounded on the whole.

The first electrode $521_n$ is electrically connected to a terminal $324_n$ via a conductor $323_n$ formed in a through-hole of the base member 110 by some method. Specific examples of the connection method are the same as those in the first embodiment (FIGS. 9 to 11). As shown in FIGS. 17 and 22, the second electrode $421_n$ is electrically connected to a terminal $424_n$ via a conductor $423_n$ formed in a through-hole of the base member 210. Either one of the terminal $324_n$ and the terminal $424_n$ is connected to a device attached to clothing or a human body, and the other is connected to an outside measuring instrument or another apparatus. Since the connector assembly of the third embodiment has the above-described structure, it provides the same effect as the first embodiment.

DESCRIPTION OF REFERENCE NUMERALS

100, 300, 500: First connector
110, 210: Base member
120, 320, 520: First electrical-connection member
121, 321, 521: First electrode
122, 322, 522: Protrusion
123, 223, 323, 423: Conductor
124, 224, 324, 424: Terminal
125, 325: Space
126, 326, 526: Tip
127, 227, 327, 427, 527: Side face
130, 230: Engagement member
141: Conductive thin wire
142: Electrically conductive rubber
143: Electrically conductive thin film
200, 400: Second connector
215, 415: Recess forming part
220, 420: Second electrical-connection member
221, 421: Second electrode
222, 422: Recess
223, 423: Conductor
226, 426: Bottom
428: Opening

What is claimed is:

1. A connector assembly comprising:

a first connector having a first electrical-connection member arranged on a base member; and a second connector having a second electrical-connection member arranged on a base member at a position opposite that of the first electrical-connection member;

the first connector and the second connector further comprising engagement members at positions opposite each other;

the first electrical-connection member comprising an elastic protrusion and a first electrode arranged at a tip of the elastic protrusion;

the second electrical-connection member comprising a recess and a second electrode arranged at a bottom of the recess;

at least one of the base member of the first connector and the base member of the second connector has flexibility; and when the engagement members engage, the first electrode and the second electrode are brought into contact, and the elastic protrusion and the recess are brought into contact so as to prevent water from reaching the contact point of the first electrode and the second electrode.

2. The connector assembly according to claim 1, wherein the recess is also elastic.

3. The connector assembly according to claim 1, wherein both the base member of the first connector and the base member of the second connector have flexibility.

4. The connector assembly according to claim 1, wherein the elastic protrusion is hollow.

5. The connector assembly according to claim 1, wherein the engagement members constitute a resin fastener.

6. A connector assembly comprising:

a first connector having a first electrical-connection member arranged on a base member; and a second connector having a second electrical-connection member arranged on a base member at a position opposite that of the first electrical-connection member;

the first connector and the second connector further comprising engagement members at positions opposite each other;

the first electrical-connection member comprising an elastic protrusion and a first electrode arranged at a tip of the elastic protrusion;

the second electrical-connection member comprising a recess and a second electrode arranged at a bottom of the recess;

at least one of the base member of the first connector and the base member of the second connector has flexibility; and when the engagement members engage, the first electrode and the second electrode are brought into contact, and at least part of a side face of the elastic protrusion is brought into contact with a side face of the recess over the perimeter thereof.

7. The connector assembly according to claim 6, wherein the recess is also elastic.

8. The connector assembly according to claim 6, wherein both the base member of the first connector and the base member of the second connector have flexibility.

9. The connector assembly according to claim 6, wherein the elastic protrusion is hollow.

10. The connector assembly according to claim 6, wherein the engagement members constitute a resin fastener.

11. A connector assembly comprising:

a first connector having a first electrical-connection member arranged on a base member; and a second connector having a second electrical-connection member arranged on a base member at a position opposite that of the first electrical-connection member;

the first connector and the second connector further comprising engagement members at positions opposite each other;

the first electrical-connection member comprising an elastic protrusion and a first electrode arranged at part of a tip of the elastic protrusion;

the second electrical-connection member comprising a recess and a second electrode arranged at part of a bottom of the recess;

at least one of the base member of the first connector and the base member of the second connector has flexibility; and when the engagement members engage, the first electrode and the second electrode are brought into contact, and the tip of the elastic protrusion, except for a portion where the first electrode is formed, is brought into contact with the bottom of the recess, except for a portion where the second electrode is formed, so as to surround the first electrode and the second electrode.

12. The connector assembly according to claim 11, wherein the recess is also elastic.

13. The connector assembly according to claim 11, wherein both the base member of the first connector and the base member of the second connector have flexibility.

14. The connector assembly according to claim 11, wherein the elastic protrusion is hollow.

15. The connector assembly according to claim 11, wherein the engagement members constitute a resin fastener.

16. A connector assembly comprising:

a first connector having a first electrical-connection member arranged on a base member; and a second connector having a second electrical-connection member arranged on a base member at a position opposite that of the first electrical-connection member;

the first connector and the second connector further comprising engagement members at positions opposite each other;

the first electrical-connection member comprising an elastic protrusion having a shape narrowed toward a tip and a first electrode arranged at the tip of the elastic protrusion;

the second electrical-connection member comprising a recess and a second electrode arranged at a bottom of the recess;

at least one of the base member of the first connector and the base member of the second connector has flexibility; and when the engagement members engage, the first electrode and the second electrode are brought into contact, and a side face of the elastic protrusion is brought into contact with an opening of the recess over the perimeter thereof.

17. The connector assembly according to claim 16, wherein the recess is also elastic.

18. The connector assembly according to claim 16, wherein both the base member of the first connector and the base member of the second connector have flexibility.

19. The connector assembly according to claim 16, wherein the elastic protrusion is hollow.

20. The connector assembly according to claim 16, wherein the engagement members constitute a resin fastener.

* * * * *